United States Patent [19]

Bessert

[11] Patent Number: 4,676,036

[45] Date of Patent: Jun. 30, 1987

[54] INTEGRATED RAISED FLOORING SYSTEM

[75] Inventor: David Bessert, Roselle, Ill.

[73] Assignee: Airtite, Inc., Chicago, Ill.

[21] Appl. No.: 729,465

[22] Filed: May 1, 1985

[51] Int. Cl.[4] ..... E04F 15/024

[52] U.S. Cl. ..... 52/126.6; 52/221; 52/263

[58] Field of Search ..... 52/221, 220, 263, 126.6

[56] References Cited

U.S. PATENT DOCUMENTS

| | | | |
|---|---|---|---|
| 3,157,254 | 11/1964 | Spiselman | 52/126.6 |
| 3,180,460 | 4/1965 | Liskey | 52/126.6 |
| 3,232,395 | 2/1966 | La Barge | 52/461 |
| 3,321,880 | 5/1967 | Ferrell | 52/476 |
| 3,425,179 | 2/1969 | Haroldson | 52/126.6 |
| 3,509,674 | 5/1970 | Birum | 52/464 |
| 3,526,074 | 9/1970 | Miller | 52/397 |
| 3,696,569 | 10/1972 | Didry | 52/398 |
| 3,844,087 | 10/1974 | Schultz | 52/476 |
| 3,866,374 | 2/1975 | Dallen | 52/398 |
| 3,924,370 | 12/1975 | Cauceglia | 52/126.6 |
| 4,067,155 | 1/1978 | Ruff | 52/461 |
| 4,506,484 | 3/1985 | Bartlett | 52/476 |
| 4,557,089 | 12/1985 | Breithaupt | 52/464 |

FOREIGN PATENT DOCUMENTS

| | | | |
|---|---|---|---|
| 2631315 | 1/1978 | Fed. Rep. of Germany | 52/397 |
| 1306680 | 9/1962 | France | 52/126.6 |
| 516729 | 5/1962 | Italy | 52/263 |

OTHER PUBLICATIONS

Tate Access Floors, 10/1984, Tate Architectural Products, Inc.

Access Flooring by C-Tec, C-TEC, Inc.

A Wireway, Interstitial Systems, Inc.

Tate Access Floors Model 801, Snap-on Stringer System and Model 902 Stringerless System, 9/85, Tate Architectural Products, Inc.

Donn Access Floor Systems, 10.27/Do, Donn Corporation.

Floating Floors, 10.27 FL, Floating Floors, Inc.

Access Floor Systems, Liskey Architectural Mfg., Inc., 10.27/Li.

CTEC, a New Horizon in Access Flooring, C-TEC, Inc.

NAP Access Floor Systems, CAT-KAG8503SS, NAP Industries.

ConCor ® 900 Series Access Floor Panel, Tate Architectural Products, Inc.

*Primary Examiner*—John E. Murtagh

*Attorney, Agent, or Firm*—Dean A. Monco

[57] ABSTRACT

A multi-tiered flooring arrangement, with each level of floor acting as a self-contained conduit. The system comprises a series of vertical support members and horizontal connectors arranged in generally rectangular shape onto which are placed removable flooring surfaces which act as separators for defining a plurality of separated plenum spaces for containing selected conductors and conduits.

17 Claims, 8 Drawing Figures

H.V.A.C.
UNIT
24

46
181b
181a
181c
182a
12
182b
183
184
21
LOW
VOLTAGE
36
7
7
52
29
51a
51
26
264a
264b
26a
HIGH
VOLTAGE
50
32
360
30
54
362
262d
28
48
17
16

INTEGRATED RAISED FLOORING SYSTEM

BACKGROUND OF THE INVENTION

It is common for computers to be positioned in rooms having an additional floor level above the floor of the room to conceal the required wiring. Large main frame computers require a tremendous amount of wiring to provide high voltage and low voltage for operation, as well as heating, ventilating, and air conditioning for the surrounding atmosphere in order to provide a proper working environment for the computer itself and for its operators. Prior to the present invention, the high voltage and low voltage wires were maintained in separate metal conduits called raceways which provided little flexibility for movement. These raceways were usually rectangular electrical conduits laid out on a gridwork having six to ten foot centers which used T's and elbows to position the raceway properly. The raised access flooring support structure was secured by a series of mechanical fasteners such as nuts and bolts. The raceways were positioned below the raised access floor.

If movement of the main frame computer was required, or if additional equipment had to be added, the operator would have to unfasten the bolts securing the access flooring over a wide area, and literally disassemble the raceways in order to reposition it in accordance with the new position of the main frame computer.

Additionally, if repair work had to be done, this would also entail unfastening the bolts securing the access flooring and cutting through or disassembling the raceway conduit until the problem wiring was located. This resulted in an excessive amount of down time for a computer as well as the expenditure of large amounts of time for repair and/or relocation activities.

It is an object of this invention to provide a flexible and easily accessible means for altering the position of wiring used with main frame computers, permitting the easy movement of the computers themselves.

It is a second object of the present invention to provide a means for doing away with electrical conduits used to segregate low voltage wires and high voltage wires used in conjunction with main frame computers.

It is a third object of the present invention to provide a means for securing the structural components of access floor for use in main frame computer rooms without employing mechanical fasteners.

SUMMARY OF THE INVENTION

In order to overcome the problems previously described and to achieve the objectives set forth above, the present invention was developed. The present invention is embodied in a multi-tiered access flooring system in which each plenum space formed by the tiers acts as a conduit for maintaining selected conduits and conductors in specific floor tiers. The access flooring comprises a series of vertical and horizontal support members which are constructed and arranged in such a manner as to be capable of receiving flooring panels for supporting numerous individuals.

The vertical support members comprise a series of one-piece pedestal assemblies having a base, a vertical support tube affixed to the base having one or more supporting shelf members affixed thereto, and a pedestal head which is inserted into the vertical support tube. The vertical support members are positioned in a generally square configuration with respect to one another.

The horizontal support members comprise a one-piece member having a plurality of grooves formed on their exterior. The horizontal support members extend between the vertical support members. The supporting shelf members of the vertical support members are inserted onto ridges formed on the interior walls of a groove formed on the horizontal support member and are secured thereto in a locked fashion. No mechanical fasteners of any kind are used.

Flooring members are positioned on the horizontal support members so that the edges of the flooring members are inserted into grooves formed on adjacent horizontal support members. To secure the flooring members in such a manner as to limit the amount of air leakage from one plenum to another, a hold-down gasket having edges overlapping the edges of the flooring members is inserted into a groove on the horizontal support member. A removable flooring member is then laid onto the pedestal heads.

When completed, the plenum spaces formed between tiers of the access flooring will serve as conduits for select conductors and conduits, such as low voltage wiring, high voltage wiring, and heating, ventilating and air conditioning ducts.

DESCRIPTION OF THE PREFERRED EMBODIMENT

While the principles of the present invention define a particular utility in a multi-tiered access flooring system, it will be understood that the access floor system arrangement of the present invention may be utilized in other combinations or for other purposes. By way of exemplary disclosure of the best mode of practicing the invention, and by way of enabling one of ordinary skill in the art to practice the invention, the preferred embodiment is shown in FIGS. 1–18.

Figure 1:
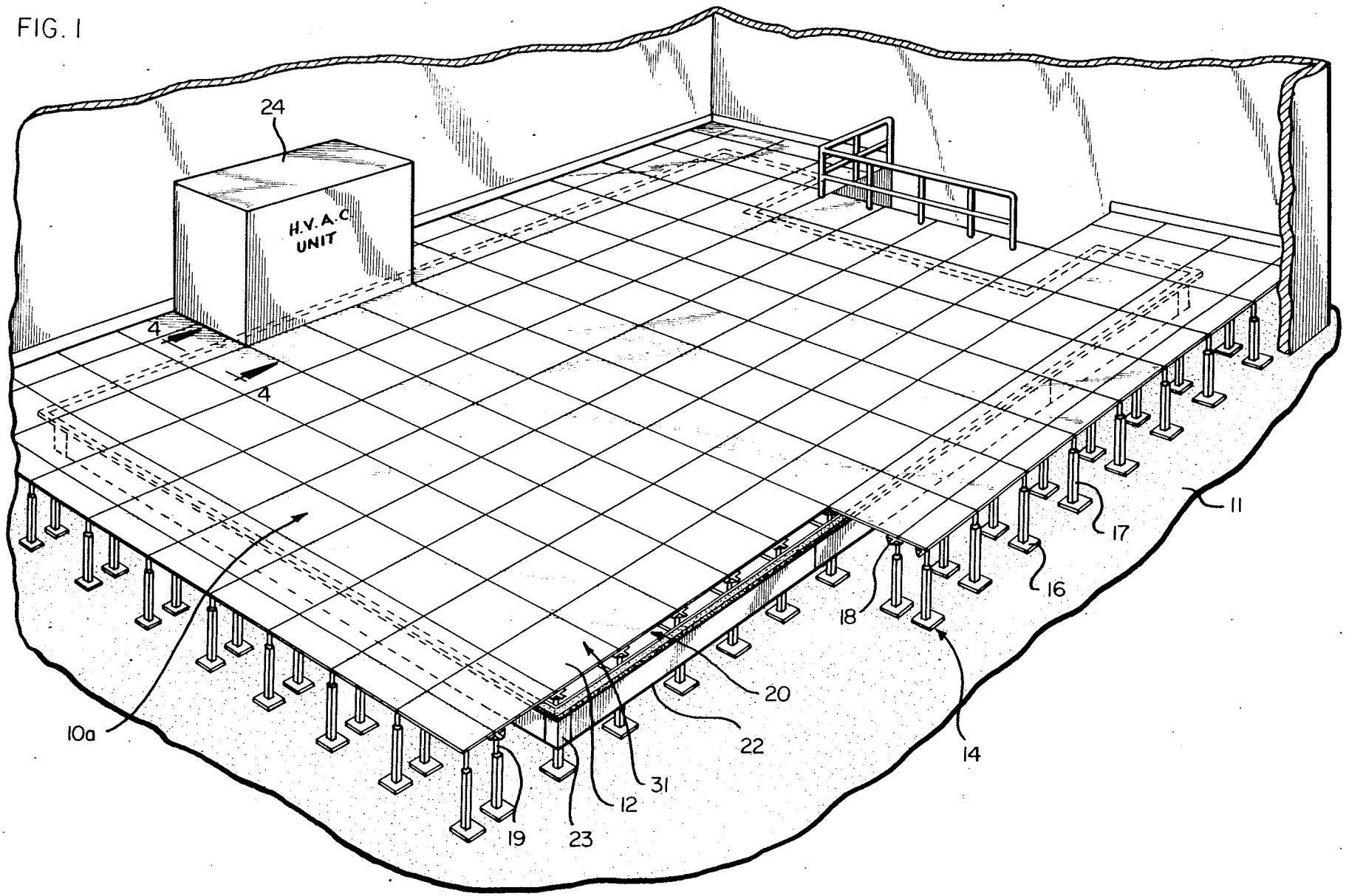
FIG. 1 is a perspective view of an access floor system in accordance with the principles of the present invention.

By way of illustrating the present invention, FIG. 1 shows a raised, multi-tiered access floor system 10 as it is positioned on subfloor 11. The access floor system 10 comprises on the top floor level 10*a*, a series of generally square shaped finished access floor members or panels 12, which are laid side by side in a configuration conforming generally to the dimensions of a computer room facility. The top removable floor panels 12 are supported at each individual corner by vertical support members comprising a pedestal assembly 14 having a base 16, vertical support tubes 17 extending from the base 16, and one-piece pedestal head members 18 adjustably mounted to the hollow vertical support tubes 17 by means of threaded screw members 19 inserted into the top of the support tubes 17.

A second level access floor system 20 is positioned directly beneath the top level removable access floor panels 12 and in between these two floor levels a plenum space 21 for low voltage wires is formed. The vertical plenum barrier 22 is positioned between the edges of the first level access floor system 10 and a second level access floor 20 in order to prevent air leakage. Corner cap sealers 23 are placed at the corner junctions of plenum barriers 22 in order to minimize air leakage.

A heating, ventilating, and air conditioning unit (HVAC) 24 is positioned within the room so as to provide the proper atmospheric conditions for operating a main frame computer.

Figure 2:
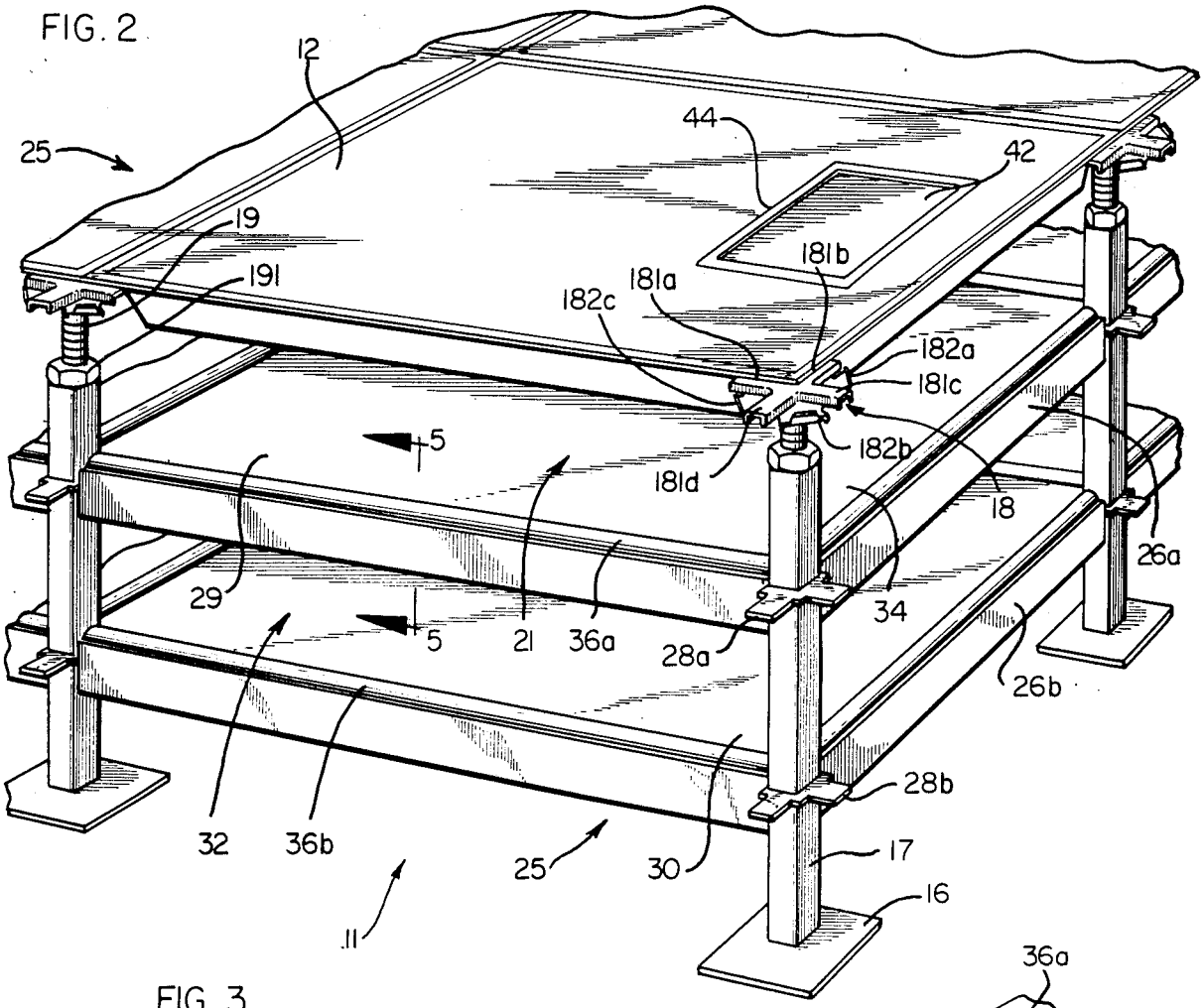
FIG. 2 is an enlarged fragmentary perspective view of one section of access flooring.

FIG. 2 illustrates a complete access flooring module unit 25. The base 16 of the pedestal assembly 14 is secured to the subfloor 11 by adhesives. The vertical support tube 17 is welded to the base 16. The pedestal assemblies 14 are generally made of eleven guage steel to provide proper strength to support operators of the computer equipment.

The horizontal support members or pan support stringers 26*a*, 26*b* extend between and connect pedestal assemblies 14. The stringers 26, made of extruded aluminum, are secured to stringer support clips 28 by means of a twist locking motion. No mechanical fasteners are used.

The support clips 28*a* and 28*b* are one piece cross-shaped metal support members having a central bore conforming to the shape of the vertical support tube 17. In forming the pedestal assembly, the vertical support tube 17 is inserted into stringer support clip 28. The support clip 28*b* is then moved downwardly until it is positioned at the height from the pedestal base 16 desired for use. At that point, a stringer support clip is welded to the vertical support bar 17. The same process is continued for support clip 28*a* which is positioned at a higher level on the vertical support bar 17 where it is welded to form a one-piece unit comprising the pedestal assembly 14. In this manner, a multiple level support structure can be created, with as many levels as required.

The pedestal head 18 is generally a stamped piece of metal having elevated cross members 181*a*, 181*b*, 181*c*, and 181*d*. Between the cross members 181*a*, 181*b*, 181*c*, and 181*d* are formed depressed support shelves 182*a*, 182*b*, 182*c*, and 182*d* having upwardly bent edges capable of securably receiving floor pans 12. Attached to screw member 19 is a leveling nut 191 having a diameter greater than that of the support tube 17. The leveling nut 191 is used to adjust top level floor pans 12 to conform to the vagaries of subfloor 11 so as to provide a level walking surface for an operator.

A second level floor member or panel 29 and a third level floor member or panel 30 are positioned on the module so that flanges formed on the edges of the panels 29 and 30 can be inserted into grooves formed on the support stringers 26. These flanges are inserted into grooves formed on four individual stringers 26. The space between floor panels 29, 30 forms the area defining a second plenum space 32 for containing high voltage wires. Pan hold down gaskets 36*a*, 36*b* are inserted into grooves formed in each of the support stringers 26 at each level of the module 25, forming an substantially air tight sealing arrangement.

The area formed between the second level floor panel 29 and the top level floor panel 12 is the first plenum space 21 for containing low voltage wires.

Access to the first level plenum space 21 is provided by a cut out member 42 formed on top level floor panel 12 having molded edges 44 to protect cables from any sharp edges.

Figure 3:
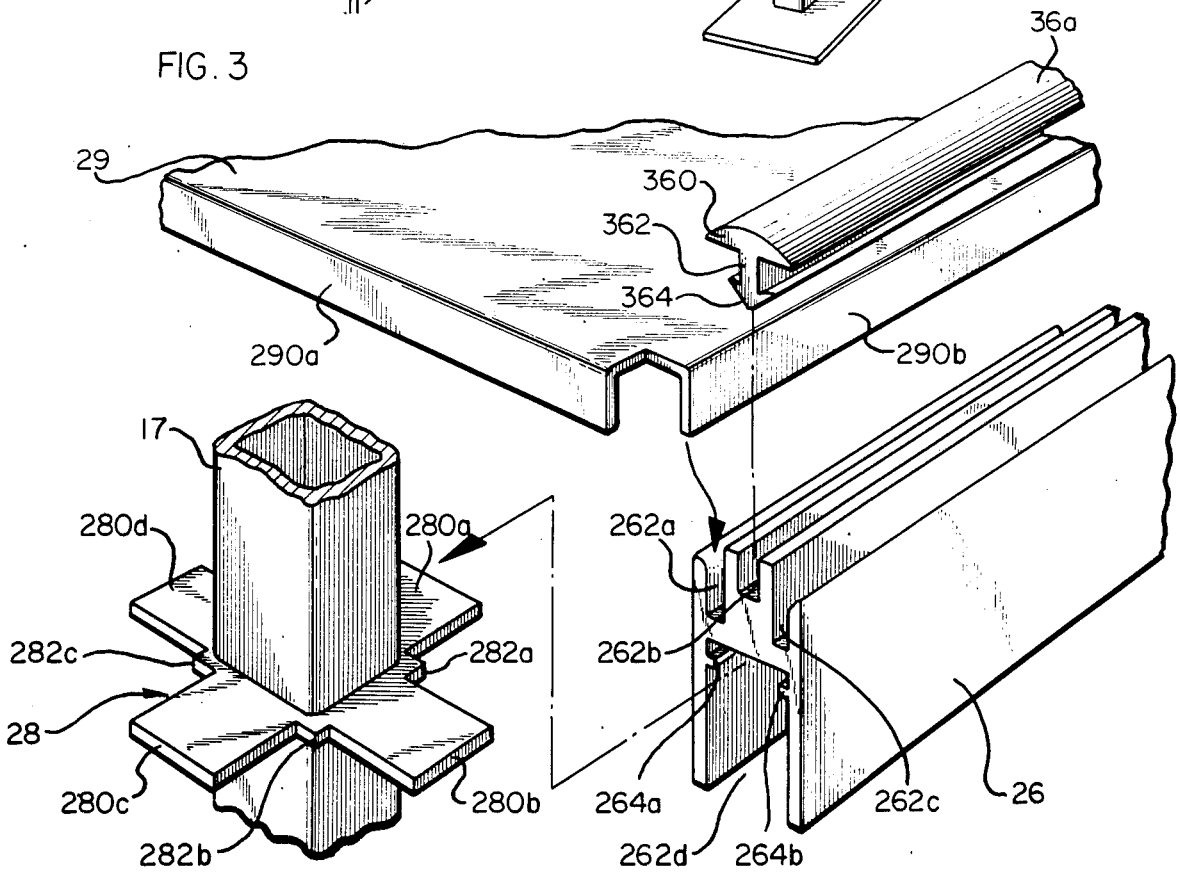
FIG. 3 is an enlarged fragmentary perspective view of the component parts of the access flooring.

As shown in FIG. 3, the support clip 28 is a cross shaped member having four support members 280*a*, 280*b*, 280*c*, and 280*d*. Ridge members 282*a*, 282*b*, 282*c*, and 282*d* (not shown) are formed at generally right angles along the side edges of clip extension members 280*a*, 280*b*, 280*c*, 280*d* in order to provide additional strength.

The pan support stringer 26 comprises a one piece member on which are formed three U-shaped grooves 262*a*, 262*b*, 262*c*. A relatively large inverted U-shape groove 264 is formed on the underside of support stringer 26. A pair of generally parallel ridges 264*a*, 264*b*, are formed on the interior walls of the inverted U-shaped groove 262*d*. The edges of the outer walls forming grooves 262*a*, 262*c* are smooth and tapered to prevent any cutting or fragmenting of wires.

Second level floor panel 29 has edges 290*a*, 290*b* which are bent at generally right angles. The pan gasket 36*a* is a one piece folded rubber or plastic member having a generally semi-circular shaped top portion 360 which overlaps grooves 262*a*, 262*c* from which descends generally along its mid line a perpendicular member 362 ending in a V-shaped gusset portion 364.

When assembling one section of the module 25, support stringer 26 is positioned in a generally diagonal orientation and twisted in such a manner that clip extension member 280*a* will be inserted into inverted U-shaped groove 264, and the support stringer will be twisted in the opposite direction until clip extension 280*a* is positioned above parallel ridges 264*a*, 264*b* formed on the inside walls of stringer 26. Edge 290*b* of second level floor panel 29 is then inserted into the U-shaped groove 262*a*. The perpendicular edge from another low voltage pan is then inserted into groove 262*c*. Finally, gusset portion 364 is inserted into groove 262*b* and pushed downwardly until top portion 360 of pan gasket 36*a* firmly secures the edges of adjoining second level floor panels 29 to form a generally air tight sealing arrangement. The edges 290*a*, 290*b* are recessed at their intersection to permit insertion into adjacent, perpendicular stringers 26.

Figure 4:
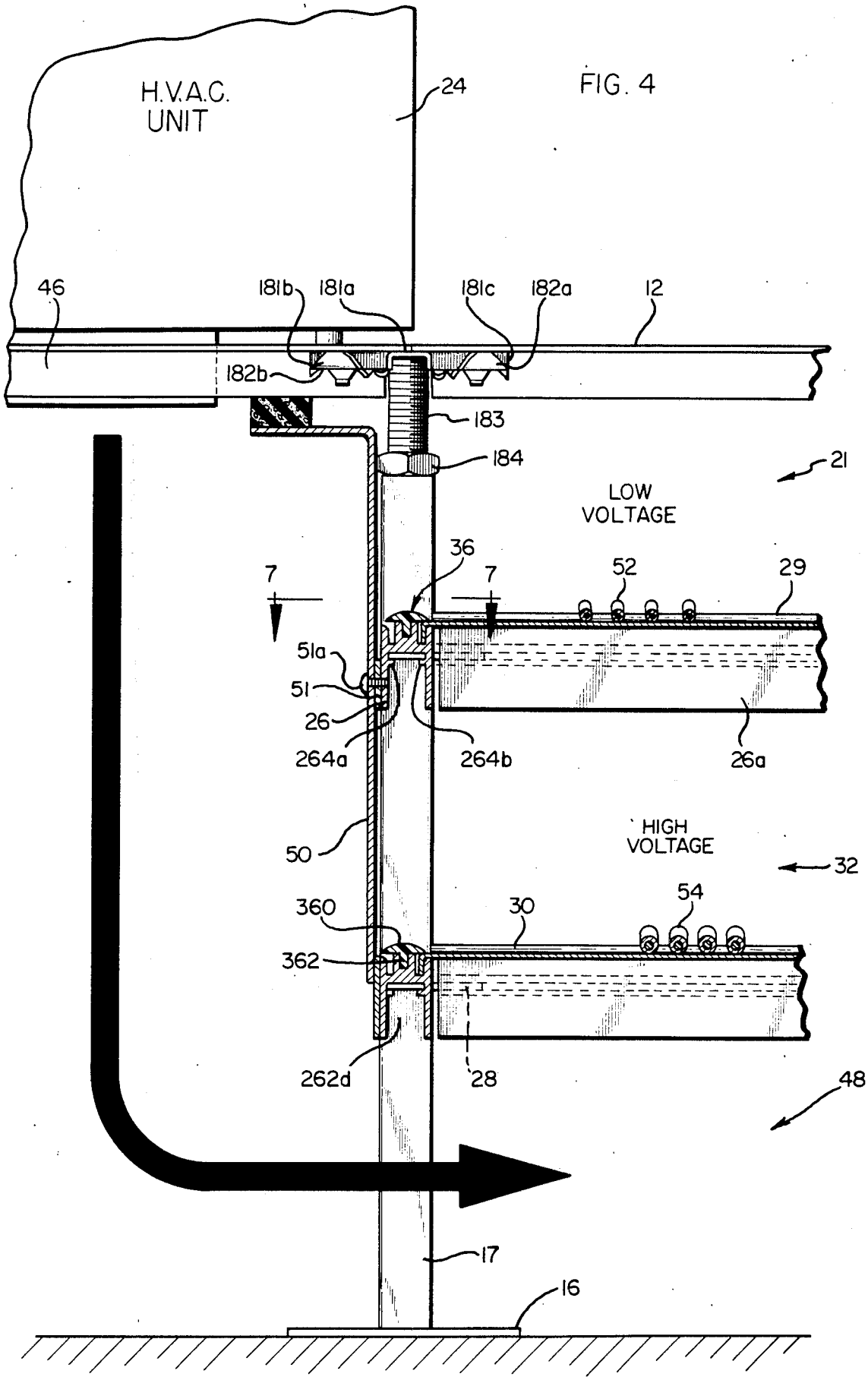
FIG. 4 is a section view taken along line 4—4 of FIG. 1.

FIG. 4 illustrates the segregation of wiring and air circulation apparatus. Top floor panel 12 rests on a portion of the pedestal head 18. Air of a desired temperature is directed from the HVAC unit 24 through vent 46 downwardly into HVAC plenum 48 where it will be directed to the desired areas in the computer room.

Pressurized air leaving the HVAC unit 24 enters plenum space 48. Selected panels 29 and 30 may be removed at desired locations, creating shafts into which the pressurized air is driven. The pressurized air is then released into the environment via vents positioned on selected access floor panels 12 positioned directly above the shafts.

A plenum barrier 50 is fastened to the perimeter support stringer 26 by means of metal adhesive strips 51. Additionally, a securing screw 51*a* is inserted into the plenum barrier 50 and the support stringer 26. This greatly diminishes air leakage from the HVAC unit 24 into the first plenum space 21 and the second plenum space 32. Low voltage wires 52 are laid on top of second level floor panel 29 in any location desired by the user. Likewise, high voltage wires 54 are placed on third level floor panel 30 in any position desired by the user.

With the present invention, low voltage wires 52, high voltage wires 54, and circulating air from the HVAC unit 24 are maintained completely separate from one another in such a manner that each level of the access flooring system 10 becomes a self-contained conduit.

Figure 5:
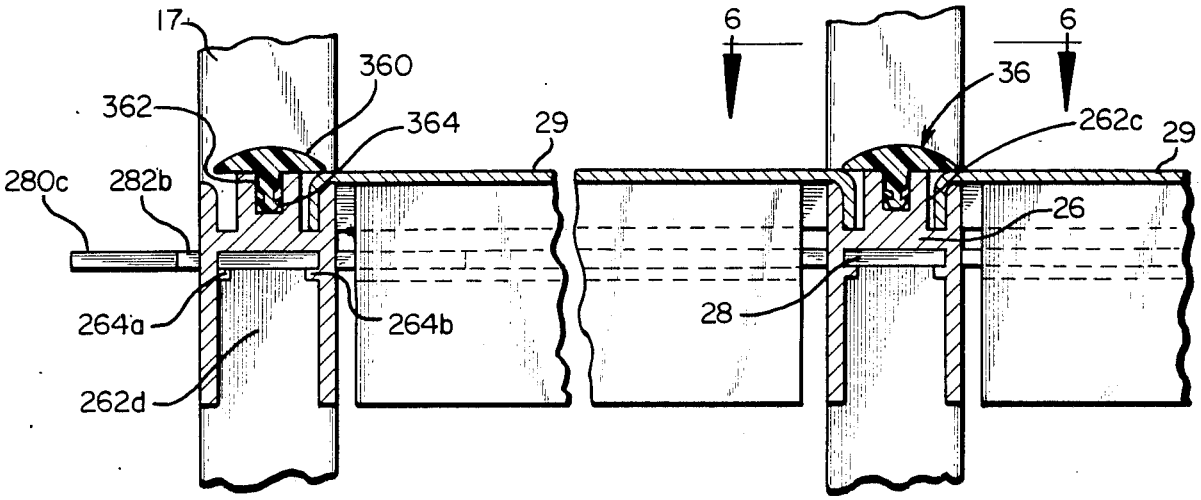
FIG. 5 is a sectional view taken along line 5—5 of FIG. 2.

FIG. 5 shows a detailed illustration of the pan stringer 26 secured to support clip 28. The edges of adjacent second level floor panels 29 are inserted into the grooves *262a, 262c* formed on support stringer 26. The pan gasket 36 provides a positive plenum seal substantially preventing air leakage into or out of any plenum area.

Figure 6:
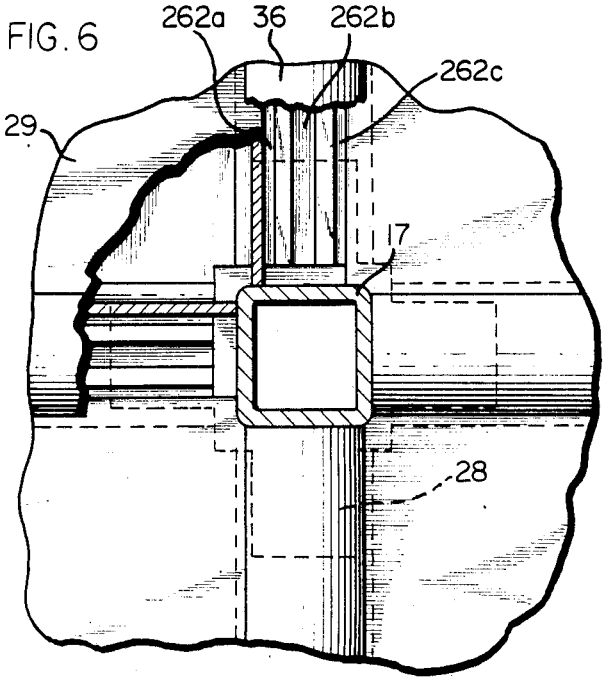
FIG. 6 is the sectional view taken along line 6—6 of FIG. 5.

FIG. 6 is a top cross-sectional view of a sealing arrangement of the stringers 26 and the support clips 28 as they are secured by the hold down pan gaskets 36.

Figure 7:
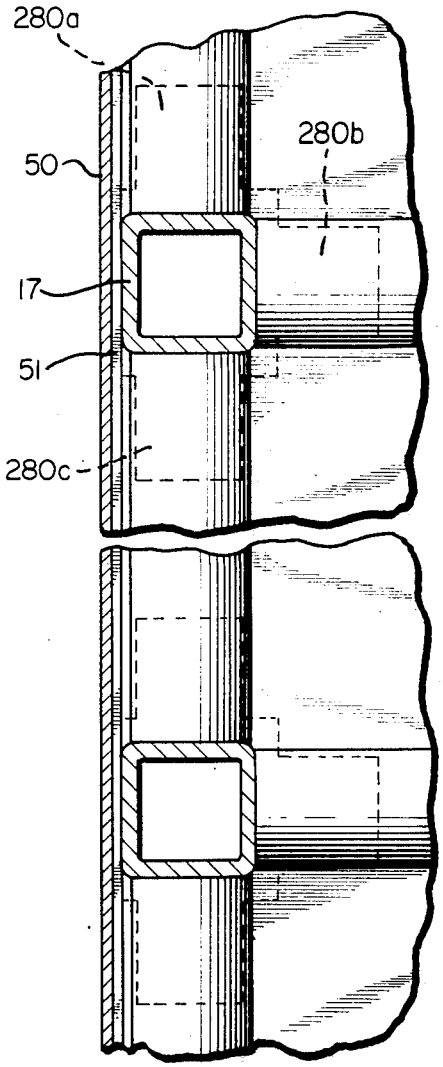
FIG. 7 is a sectional view taken along line 7—7 of FIG. 4.

FIG. 7 is a top cross-sectional view of an end member pedestal assembly 14. Only three clip extension members *280a, 280b, 280c,* are formed on the support clip 28 for these pedestal assemblies 14 which abut either a wall or some other objects such as the HVAC unit 24.

Figure 8:
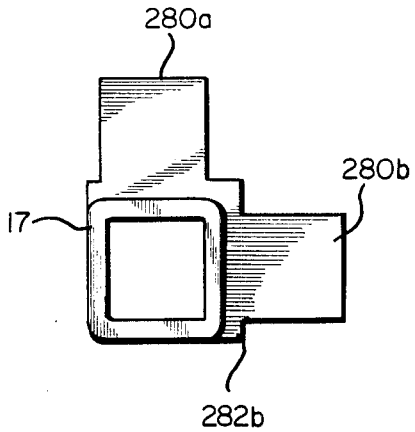
FIG. 8 is a top view of a corner support clip.

FIG. 8 is an illustration of a support clip 28 which is used at the corner of an access flooring system 10. These particular support clips 28 have only two clip extension members *280a, 280b.*

Although various modifications might be suggested by those skilled in the art, it should be understood that the inventor wishes to embody within the scope of the patent warranted here all such modifications as reasonably and properly come within his contribution to the art.

What is claimed is:

1. In a raised flooring system comprising a plurality of floor panels and a plurality of support pedestals standing on a subfloor, and a plurality of horizontal connecting members, the improvement comprising, in combination:

means carried by the pedestal for mounting at least one panel intermediate the floor panels and the subfloor to define a plurality of separate plenums therebetween, said means including support means carried by said support pedestals intermediate its ends, a horizontal locking support member connected by twist locking means to said support means carried by adjacent support pedestals carried by said support means, said intermediate panels extending between and supported by said horizontal support members, and a hold down gasket means for securing said floor panels to said horizontal support members, said gasket means having edges overlying edges of said floor panels and a center portion removably inserted into said horizontal support member, so as to substantially prevent horizontal and vertical movement of the floor panels while providing good continuous contact between the floor panels and the horizontal support members.

2. A raised adjustable access flooring system for use in computer rooms comprising:

a series of vertical support means;

horizontal support means connected to the vertical support means by twist locking means for connecting said support means in a locked mode in a multi-tiered arrangement;

receiving means formed on said horizontal support means;

floor panels having edges capable of being inserted into said receiving means of said horizontal support means;

hold-down gasket means having edges overlying the floor panel edges and further having a radially extending center portion capable of being removably inserted into the horizontal support member for securing said floor panel and said horizontal support means in an air-tight sealing arrangement; and plenum spaces formed by said floor panel arranged in a multi-tiered fashion so as to provide conduit means for separating low voltage wires, high voltage wires and heating, ventilating and air conditioning ducts in substantially air-tight, separate chambers.

3. The access flooring system according to claim 2 in which said vertical support means have one or more support clips affixed to them in a multi-tiered arrangement.

4. The access flooring system according to claim 3 in which said support clips are cross shaped.

5. The access flooring system according to claim 3 in which said vertical support means and said support clips are metal, and are affixed to one another by welding.

6. The access flooring system according to claim 2 in which a pedestal assembly is inserted into said vertical support means and used to support top tiered floor panels.

7. The access flooring system according to claim 6 in which said pedestal assembly is a one-piece member comprising a threaded stem capable of being inserted into said vertical support tube, a leveling nut into which said threaded stem is inserted for adjusting the height of said top tiered floor panels and further having a diameter greater than the width of the vertical support means, and a head having a raised cross shaped configuration and support shelf members formed between said cross members which are capable of receivably supporting said floor panels.

8. The access flooring system according to claim 2 in which said horizontal support means are pan support stringers on which are formed a plurality of grooves.

9. The access flooring system according to claim 8 in which one inverted, U-shaped groove formed in the underside of said support string has two generally parallel support rails formed on the interior walls of said inverted U-shaped groove member capable of supporting single cross shaped support clip members, so as to substantially prevent any vertical movement of the horizontal support member during use.

10. The access flooring system according to claim 8 in which two U-shaped groove members are formed on the upper surface of said support stringer which are capable of receiving the edges of said floor panels.

11. The access flooring system according to claim 2 in which the top tiered floor panel is an access flooring panel having means capable of being grasped by a user to lift and remove said floor panel for inspecting the underlying plenum spaces.

12. The access flooring system according to claim 11 in which selected top tiered floor panels have vents on their surfaces to permit the passage of air from below into the computer room.

13. The access flooring system according to claim 11 in which said grasping means comprises a cut-out member.

14. The access flooring system according to claim 2 in which said gasket means comprises a one-piece rubber or plastic gasket having a generally semi-circular head, a perpendicular portion descending from said head, and a generally V-shaped gusset portion formed at the end of said perpendicular portion and capable of being inserted into said horizontal support means in such a manner to provide a positive seal over the edges of said floor panels and to secure said floor panels to said horizontal support means.

15. A raised adjustable access flooring system for use in computer rooms comprising:

a series of pedestal assemblies comprising a base, a vertical support tube, and an adjustable pedestal head;

support clips affixed to said vertical support tube of said pedestal assemblies in a multi-tiered arrangement;

support stringers extending between said pedestal assemblies and connected to said support clips by twist locking means;

floor panels having edges capable of being inserted into said support stringers;

panel hold down gaskets inserted into said stringers and having edges overlying the edges of the floor panels so as to provide a substantially air-tight seal for securing said edges of said panels to said support stringers while substantially preventing horizontal and vertical movement of said floor panels; and plenum spaces formed by said floor panels arranged in a multi-tiered fashion so as to provide conduit means for separating low voltage wires, high voltage wires, and heating, ventilating and air conditioning ducts in air-tight separate chambers.

16. The access flooring system according to claim 14 in which said support stringers are carried on said support clips by means of a twisting action without using mechanical fasteners.

17. A raised adjustable flooring system having a series of horizontal support means connected to a series of vertical support means by twist locking means, and hold-down gasket means having edges overlying edges of floor panels inserted into said horizontal support means so as to substantially prevent horizontal and vertical movement of the floor panels, so as to define a plurality of generally air-tight plenum spaces arranged in a multi-tiered fashion so as to provide conduit means for separating low voltage wires, high voltage wires, and heating, ventilating and air conditioning ducts.

* * * * *